US005863886A

United States Patent [19]

Tracy et al.

[11] Patent Number: 5,863,886

[45] Date of Patent: Jan. 26, 1999

[54] NONIONIC GEMINI SURFACTANTS HAVING MULTIPLE HYDROPHOBIC AND HYDROPHILIC SUGAR GROUPS

[75] Inventors: David James Tracy; Ruoxin Li, both of Plainsboro; Jiang Yang, Hightstown, all of N.J.

[73] Assignee: Rhodia Inc., Cranbury, N.J.

[21] Appl. No.: 923,376

[22] Filed: Sep. 3, 1997

[51] Int. Cl.[6] ..... C11D 1/68

[52] U.S. Cl. ..... 510/470; 510/502; 510/505

[58] Field of Search ..... 510/470, 502, 510/505

[56] References Cited

U.S. PATENT DOCUMENTS

| | | | |
|---|---|---|---|
| 4,892,806 | 1/1990 | Briggs et al. | 430/449 |
| 5,160,450 | 11/1992 | Okahara et al. | 252/174.21 |
| 5,403,922 | 4/1995 | Garelli-Calvet | 536/1.11 |
| 5,488,180 | 1/1996 | Jenkins et al. | 568/609 |
| 5,534,197 | 7/1996 | Scheibel et al. | 510/356 |
| 5,585,516 | 12/1996 | Varadaraj et al. | 562/42 |
| 5,622,938 | 4/1997 | Wong | 514/35 |
| 5,643,864 | 7/1997 | Li et al. | 510/499 |

FOREIGN PATENT DOCUMENTS

| | | |
|---|---|---|
| 028024 A1 | 5/1981 | European Pat. Off. . |
| 480714 A2 | 4/1992 | European Pat. Off. . |
| 688781 | 12/1995 | European Pat. Off. . |
| 43 21 022 | 5/1995 | Germany . |
| PCT/US95/19951 | 7/1995 | WIPO . |
| PCT/US95/19955 | 7/1995 | WIPO . |

OTHER PUBLICATIONS

G.R. Newkome et al., Synthesis and Characterization of Two–Directional Cascade Molecules and Formation of Aqueous Gels, Journal of the American Chemical Society 1990, vol. 112, 8458–8465, Dec. 1990.

Whalley, G.; Sugar–Based Surfactants; Happi 98–102 (Apr. 1997).

Allouch, et al.; Nonionic Amphiphilic Compounds from Aspartic and Glutamic Acids as Structural Mimics of Lecithins; JAOCS 73, No. 1 (1996) 87–95.

Eastoe, et al.; Properties of New Glucamide Surfactants; Langmuir 12, (1996) 2701–2705.

Seguer, et al.; Nonionic Amphiphilic Compounds from Lysine as Molecular Mimics of Lecithins; JAOCS 73 No. 1 (1996) 79–85.

Zhang, et al.; Novel Polysaccharide Surfactants. The Effect of Hydrophilic and Hydrophobic Chain Length on Surface Active Propeties; J. Colloid Interface Sci. 177, (1996) 419–426.

Andre–Barres, et al.; New Double Chain Surfactants Derived From Glucose and Lactose; New J. Chem 19, No. 4, (1995) 345–347.

Briggs, et al.; Synthesis and Properties of Some Novel Nonionic Polyol Surfactants; J. Chem. Soc. 46, (1995) 379–380.

Eastoe, et al.; Properties of a Dichained Sugar Surfactant Langmuir 10, (1994) 4429–4433.

Seguer, et al.; New Nonionic Surfactants from Lysine and Their Performance; J. Dispersion Sci. and Tech. 15; No. 5 (1994) 591–610.

Zhu et al.; Preparation and Properties of Glycerol–Based Double–or Triple–Chain Surfactants with Two Hydrophilic Ionic Groups; JAOCS 69; No. 7, 626–632 (Jul. 1992).

Zhu et al.; Preparation and Properties of Double–or Triple–Chain Surfactants with Two Sulfonate Groups Derived From N–Acyldiethanolamines; JAOCS 68, No. 7, 539–543 (Jul. 1991).

Zhu et al.; Preparation and Surface–Active Properties of New Amphipathic Compounds with Two Phosphate Groups and Two Long–Chain Alkyl Groups; JAOCS 68, No. 4, 268–271 (Apr. 1991).

Latge, et al.; Synthesis of Long Chain N–Alkyllactamines From Unprotected; Lactose: A New Series of Nonionic Surfactants J. Dispersion Sci. and Tech. 12; No. 3 (1991) 227–237.

Zhu et al.; Preparation and Surface Active Properties of Amphipathic Compounds with Two Sulfate Groups and Two Lipophilic Alkyl Chains; JAOCS 67, No. 7, 459–463 (Jul. 1990).

Micich, et al.; Wetting Properties of Nonionics from Branched Fatty Amides; JAOCS 65, No. 5 (1988) 820–825.

Hjelmeland, et al.; A New Class of Nonionic Detergents with a Gluconamide Polar Group; Anal.Biochem 130, (1983) 485–490.

Emmerling, et al.; Preparative Methods for the Preparation of Higher Maltoligomers and Their Coupling with Aliphatic Diramines Starch 33, (1981) 202–208.

(List continued on next page.)

*Primary Examiner*—Paul Lieberman
*Assistant Examiner*—John R. Hardee
*Attorney, Agent, or Firm*—Craig M. Bell

[57] ABSTRACT

A surfactant composition comprising compounds of the general formula:

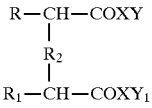

wherein $R(CO)_n$— and $R_1(CO)_n$ can be the same or different and comprise a $C_1$ to $C_{30}$ alkyl, or alkyl aryl and $R_2$ is a $C_1$ to $C_{10}$ alkylene, arylene and the hydroxy-substituted derivatives thereof, a polyether (—$O(R_4O)_x$—) wherein $R_4$ is a $C_2$ to $C_4$ alkyl and x is a whole number of from 1 to about 100; —S—, —$SO_2$—, —O—, —S—S—, —O—$R_5$—O— or —S—$R_5$—S wherein $R_5$ is a $C_1$ to $C_{10}$ alkyl, aryl or alkyl aryl, —N($R_6$)— or —($NR_6$) $R_7$ ($NR_6$)— wherein $R_6$ is a $C_2$ to $C_6$ alkyl and $R_7$ is a $C_2$ to $C_6$ alkyl or aryl with the further stipulation that $R_6$ and $R_7$ may form a heterocyclic ring, X is O or NZ wherein Z is a $C_1$ to $C_{10}$ alkyl, aryl, alkylaryl or hydrogen, and Y and $Y_1$ represents an alcohol-containing group having at least two and preferably more hydroxyl groups.

17 Claims, No Drawings

OTHER PUBLICATIONS

M. Rosen: Geminis: A New Generation of Surfactants; Chemtech (Mar. 1993) 30–33.

Menger, et al.; Gemini Surfactants: A New Class of Self Assembling Molecules; J. Am. Chem. Soc. 115, (1993) 10083–10090.

Seki, et al.; Characterization of the Complexes of Amphiphilic Poly Anions and Double Chain Cationic Surfactants; Macromolecules 25, (1992) 6540–6546.

Menger, et al.; Gemini Surfactants: Synthesis and Properties J. Am. Chem. Soc. 113, (1991) 1451–1452.

Tschierske, et al.; Novel Thermotrophic and Lyotropic Double Headed Diol–Based Mesogens; J. Chem. Soc. (1990) 1013–1014.

Fuhrhop, et al.; Routes to Functional Vesicle Membranes Without Proteins; Angew. Chem. Intl. Ed. Engl. 23, (1984) 100–113.

Lin, I.; Critical Micelle Concentration, Hydrophile Lipophile Balance, Etc. of Ionic Surfactants Containing Two Long Chain Alkyl Groups; Tenside Detergents; 17, No. 3 (1980) 113–123.

NONIONIC GEMINI SURFACTANTS HAVING MULTIPLE HYDROPHOBIC AND HYDROPHILIC SUGAR GROUPS

This invention relates to a novel group of nonionic surfactants having at least two hydrophobic moieties and at least two hydrophilic sugar groups per molecule that are useful as emulsifiers, detergents, dispersants, hydrotropes, wetting agents, corrosion inhibitors and solubilizing agents.

BACKGROUND OF THE INVENTION

Surfactants are well known materials which can be generally described as compounds having a hydrophobic moiety and a hydrophilic group per molecule. A wide variety of these materials are known and are classified as anionic, cationic, nonionic and amphoteric. They are well known to have numerous uses such as emulsifiers, detergents, dispersants and solubilizing agents in the field of cosmetics, textile treatment, industrial and personal cleaning preparations, corrosion inhibitors and the like.

Recently, a group of compounds having two hydrophobic moieties and two hydrophilic groups have been introduced. These have become known as "gemini surfactants" in the literature (*Chemtech,* March 1993, pp 30–33), and *J. American Chemical Soc.,* 115, 10083–10090, (1993) and the references cited therein. Since their introduction, cationic and anionic "gemini surfactants" have been disclosed. Other surfactant compounds having two hydrophilic groups and two hydrophobic moieties have been disclosed but not referred to as gemini surfactants.

Sulfate, phosphate, and carboxylate surfactants are currently disclosed in the literature (See JAOCS 67, 459 (1990); JAOCS 68, 268 (1991); JAOCS 68, 539 (1991); and JAOCS 69, 626 (1992). Naturally derived, non-gemini surfactants are also known in the art. Most are nonionic and consist of a fatty acid chain that is linked to a sugar molecule usually by an ether ester or amide grouping. Being naturally derived from sources such as potatoes, wheat, beet sugar or corn starch, they are more environmentally friendly than conventional surfactants yet provide excellent foaming power, are mild to the skin and are useful in a wide variety of personal care, laundry and dishwashing products.

In nonionic surfactants, the surface-active portion of the molecule bears no apparent ionic charge. Usually polyethoxy chains, glycerides or polyhydroxy functional moieties, e.g. polyglucosides, constitute the hydrophile.

Single chain nonionics can also comprise sucrose esters which are prepared by reacting sucrose with edible fatty acids under controlled conditions in order to esterify the primary hydroxyl group of sucrose. The fatty acids such as stearic, palmitic and lauric can also be further reacted with other sugar moieties to produce di-, tri, and even higher esters.

Alkyl polyglucosides are prepared by one of two methods. In one, a direct process, glucose is reacted with a fatty alcohol in the presence of an acid catalyst. Excess alcohol is removed after neutralization. In the second method, a lower alcohol and a catalyst is utilized in a two step transacetylization process. When completed, the lower alcohol is replaced with a fatty alcohol.

Finally, glucosamide surfactants are prepared by reacting glucose with mono-methyl amine in the presence of hydrogen to form N-methyl glucamine. This is then reacted with a fatty ester to produce the glucosamide. These are particularly useful as co-surfactants. An anionic derivative of these is the sugar sulfosuccinates which are obtained by reacting ethoxylated η-butyl glucosamide with maleic anhydride which is then sulfated with bisulfite. U.S. Pat. No. 5,622,938 to Wang discloses the use of sugar-based surfactants as carrier compounds for pharmaceutical actives.

Sugar-based gemini surfactants have also been previously described in the literature to a limited extent. U.S. Pat. No. 5,534,197 to Scheibel et. al. discloses and claims gemini polyhydroxy fatty acid compounds wherein the bridging group consists of a variety of alkyl, aryl, arylalkyl and aminoalkyl compounds having from about 2 to 200 atoms, and the hydrophobic heads are comprised of the same or different alcohol-containing moieties with two or more hydroxyl groups such as glycerol. The surfactants are asserted to be useful as active agents in laundry detergents, fabric cleaners, and personal care.

U.S. Pat. No. 5,403,922 to Garelli-Calvet et. al. discloses amphiphilic surfactants containing two sugar or sugar-derived head portions. The amphiphilic head portions are long chain aliphatic or branched aliphatic carbon chains. The chains are interrupted by various functional groups such as amines (—NH) and further comprise reducing glucosides comprised of a linear or cyclized carbon chain. The hydrophile is on the ends of the hydrophobe, constituting bola-type surfactants. Bola surfactants are relatively ineffective surface active compounds.

U.S. Pat. No. 5,512,699 to Conner et. al. discloses and claims poly-(polyhydroxy fatty acid amide) compounds that are asserted to be useful in laundry detergents, cleaning compositions, and personal care. Two identical long chain moieties containing hydroxyl groups are joined by a bridge consisting of polyethyleneimines, and polyethyleneamines with molecular weights below about 50,000 and preferably below 10,000. The hydrophobe is connected via carbonyl groups. U.S. Pat. No. 4,892,806 to Briggs et. al. discloses nonionic surfactants consisting of two R-groups consisting of substituted and unsubstituted alkyls, cycloalkyls, aryls or hydrogen that are joined by a carbon bridge to two hydrophilic groups represented by the formula $—CH_2NHCO(CHOH)_xCH_2OH$. The compounds are useful in emulsions for photographic light sensitive materials.

EPA 0 688 781 to Adams teaches and claims nonionic surfactants comprised of two polysaccharide sugar moieties that are linked to the central bridge of the molecule by one of their carbonyl groups. The central bridge is comprised of a polyalkyleneamine unit wherein at least one of the amine nitrogen atoms has a hydrophobic, substituted or unsubstituted hydrocarbon group linked thereto. The compounds are disclosed as being useful in aqueous hydrophilic colloid compositions such as light sensitive photographic materials.

PCT Application No. PCT/US95/00767 to Scheibel et. al. discloses and claims a class of gemini polyether fatty acid amides in which two polyethoxy, polypropoxy and/or mixed polyethoxypropoxy moieties of the general formula $[(CH_2)_yO]H$ are joined by branched or linear alkyl or aryl moieties of from 2–200 carbon atoms. The surfactants may be combined with other nonionic and anionic surfactants and enzymes in soap and laundry detergent formulations.

PCT application No. PCT/US/00769 to Scheibel et. al. discloses and claims another class of polyhydroxy diamine compounds in which two "heads" consisting of reducing sugars such as glycerol, glucose, maltose, maltodextrin and the like are joined together by a unsubstituted, linear or branched alkyl, ether alkyl or amino alkyl consisting of from two to fifteen carbon atoms.

An article by Zhang et. al., J. Colloid. Interface Sci 177 419–426 (1996) discusses the effect of hydrophobic and hydrophilic chain lengths on the surface active properties of novel polysaccharide surfactants. The nonionic saccharide surfactants consist of an amide group that links a hydrophilic saccharide segment such as glucolactone, maltolactone, and dextrolactone to a hydrophobic alkyl segment such as hexylamine, octylamine and decylamine. It was shown that the size of the saccharide segment is important in determining the interfacial surface area of the molecule and hence it's surface activity.

Eastoe et. al., Langmuir. 12, 2701–2705 (1996) discloses nonionic amphiphile surfactants comprised of two η-alkyl chains and two glucamide head groups. Surfactant purity, surfactant-water phase behavior, air-solution surface tension and small angle neutron-scattering characteristics are some of the surfactant characteristics disclosed. A second Eastoe et. al. article, Langmuir 10, 4429–4433 (1994) discusses the properties of nonionic surfactants comprised of two $C_6$ hydrophobic chains and two glucamide head groups in the same fashion.

An article to Briggs et. al. J. Chem. Soc. 46, 379–380 (1995) briefly discusses the synthesis and properties of nonionic polyol surfactants derived from carbohydrate lactones. The surface properties of these nonionic gemini surfactants are rare and very few are reported in the literature.

Due to the need for new and more effective and efficient surfactants, as well as the need for mild surfactants which are biologically compatible in an ecologically sensitive environment, effort has been made to develop a new class of compounds which demonstrate improved surface-active properties that are further characterized as mild, and environmentally benign.

Single gemini surfactants that contain two hydrophilic heads and two lipophilic chains linked by a small bridge are able to demonstrate very special physical properties such as unusually low critical micelle concentrations (cmc) and $pC_{20}$ values in aqueous media. It has been reported that ionic gemini surfactants can lower cmc values about 100 times more efficiently than single chain analogues and are about 1000 times more efficient at reducing the surface tension ($pC_{20}$). Beside these outstanding physical properties, nonionic gemini surfactants can be very effective surface active agents, are biodegradable, and to a certain extent, are available from renewable resources such as natural fats and sugars. Therefore, sugar-containing surfactants have attracted considerable attention.

The new type of sugar gemini surfactant generally contains two aliphatic long chains as lipophilic groups and two oligosaccharides as hydrophilic heads. Because sugar molecules are very water soluble, they are superior as hydrophilic heads for gemini surfactants.

Like linear sugar-based surfactants, sugar gemini surfactants can use various forms of sugar as the hydrophilic groups such as glucose, fructose, maltose, lactose, galactose, mannose, xylose and so on. Other types of gemini surfactants generally contain a polyhydroxyl group as the hydrophilic head. Their general structure is shown below.

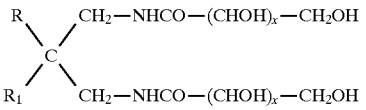

wherein R and $R_1$ represent a $C_3$ to $C_{21}$ straight or branched chain hydrocarbyl moiety. See Eastoe, and Briggs, supra.

Sugar gemini surfactants have been prepared that contain two glucose hydrophilic groups and two hydrocarbon chains linked by an ethylene group. However, these bis-monosaccharide gemini surfactants are insoluble in water.

SUMMARY OF THE INVENTION

The sugar-derived gemini surfactants of the present invention contain two saccharide moieties as the hydrophilic groups that are linked by a bridge. The general structure of the compounds is as follows:

I.

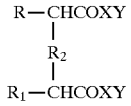

wherein $R(CO)_n$— and $R_1(CO)_n$ are the same or different linear, branched, saturated, or unsaturated alkyl aryl, or alkylaryl with a carbon chain length of from about $C_1$–$C_{30}$; n is O or I, X is O or NZ wherein Z is a $C_1$ to $C_{10}$ alkyl, aryl, alkylaryl or hydrogen and Y and $Y_1$ are the same or different alcohol-containing moieties having at least two and preferably more hydroxyl-containing groups and $R_2$ is a connecting group comprising a $C_1$ to $C_{10}$ alkyl or aryl and the hydroxy-substituted derivatives thereof, —S—, —$SO_2$—, —O—, —S—S—, or a polyether of the formula (—O$(R_4O)_x$—) wherein $R_4$ is a $C_2$ to $C_4$ alkyl and x is a whole number of from 1 to about 100, —S—$R_5$—S— and —O—$R_5$—O— wherein $R_5$ is a $C_1$ to $C_{10}$ alkyl, aryl or alkyl aryl, —N($R_6$)— and —N($R_6$)—$R_7$—($R_6$)N— wherein $R_6$ is a $C_2$ to about $C_6$ alkyl and $R_7$ is a $C_2$ to $C_6$ alkyl or aryl with the further stipulation that $R_6$ and $R_7$ may form a heteracyclic ring.

DETAILED DESCRIPTION OF THE INVENTION

The general structure of the sugar-derived gemini surfactants of the present invention is one comprising two saccharides as the hydrophilic groups connected by a bridge. The surfactants are prepared using standard amidation, condensation and reduction reactions wherein a saccharide such as lactose, maltose, glucose or fructose is condensed with an amine or an amine-containing alkyl group followed by a long chain molecule to produce a surfactant with the hydroxyl sugar at the hydrophilic end and the long chain aliphatic group at the lipophilic end.

The novel gemini surfactants of the present invention comprise two sugar moieties as the hydrophilic group that, together with the two hydrophobic groups, are linked by a bridge. The general structure of the surfactant composition is as follows:

I.

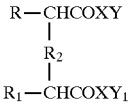

wherein R and $R_1$ independently represent the same or different linear or branched, saturated or unsaturated alkyl, aryl, or alkyl aryl with a carbon chain length of from about $C_1$ to $C_{30}$, X is O or NZ wherein Z is a $C_1$ to $C_{10}$ alkyl, aryl, alkylaryl or hydrogen and wherein Y and $Y_1$ independently represent the same or different alcohol-containing moieties having at least two and preferably more hydroxyl groups; n is O or I; $R_2$ is a connecting group comprising a $C_1$ to $C_{10}$ alkylene or arylene and the hydroxy-substituted derivatives thereof, —S—, or a polyether of the formula $(—O(R_4O)_x—)$ wherein $R_4$ is a $C_2$ to $C_4$ alkyl and x is a whole number of from 1 to about 100, $—SO_2—$, —O—, —S—S—, $—S—R_5—S—$ and $—O—R_5—O—$ wherein $R_5$ is a $C_1$ to $C_{10}$ alkyl, aryl or alkyl aryl, $—N(R_6)—$ and $—N(R_6)—R_7—(R_6)N—$ wherein $R_6$ is a $C_2$ to about $C_6$ alkyl and $R_7$ is a $C_2$ to $C_6$ alkylene or arylene with the further stipulation that $R_6$ and $R_7$ may form a heterocyclic ring.

Preferably the Y moieties are selected from the group comprising monosaccharides, disaccharides, polysaccharides and the like. Suitable monosaccharides include glyceraldehyde, erythrose, threose, ribose, arabinose, xylose, lyxose, allose, altrose, glucose, fructose, mannose, gulose, idose, galactose, and talose. Disaccharides represented by Y and $Y_1$ include, but are not limited to lactose, maltose, cellobiose, sucrose, gentobiose and mixtures thereof. Suitable polysaccharides that may be represented by Y and $Y_1$ include amylose, amylopectin, trehalose and the like. Preferably, the Y groups represent a disaccharide such as lactose or maltose, and $R_2$ is an alkyl dithiol.

The general reaction process can be schematically represented as follows:

I. Bridged Gemini Sugar Surfactants a) Preparation of the Alpha-Halo Acid Chloride Intermediate A fatty acid or β-ketoacid is reacted with thionyl chloride in the presence of bromine to yield an alpha-halo fatty acid chloride.

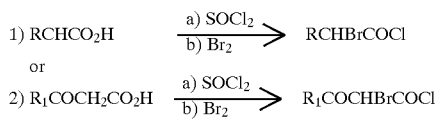

b) Condensation of Fatty Acid Chloride with Sugar

Next, a sugar moiety of choice is condensed with the fatty acid chloride to yield the ester derivative of that sugar.

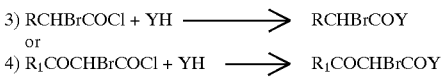

wherein Y is a sugar and mixtures thereof.

c) Coupling of the Alpha Bromosugar Derivative

Two of the alpha-halo fatty acid ester chains are coupled or linked with a sulfur, oxygen, nitrogen or other similar bridge. Here, sodium sulfide is used to produce the connecting bridge.

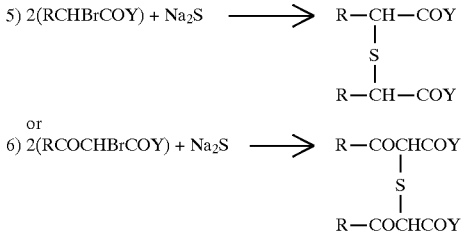

II. Bridged Gemini Sugar Amine Surfactants a) Preparation of the Alpha-Halo Intermediate As before, a fatty acid or β-ketoacid is reacted with thionyl chloride and bromine to produce the alpha-halo fatty acid chloride:

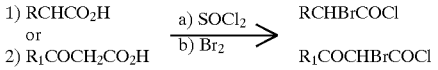

b) Reaction Fatty Acid Chloride With an Aminosugar

The alpha-halo fatty acid chloride is condensed with a sugar amine or an alkylamino sugar. Glucose, lactose, or other sugar can be reacted with ammonia or alkyl amine to produce a glucosamine. See Likhosherstov, L. M. et al; Carbohydr. Res. 146, c1–c5, (1986); Kallin, E.; Lonn, H.; Norberg, T. and Elofsson, M.; J. Carbohydr. Chem. 8, 597–611, (1989); and Kallin, E.; Lonn, H.; and Norberg, T.; Glycoconjugate J., 5, 145–150, (1988) which are hereby incorporated by reference.

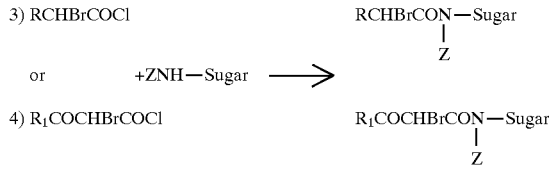

wherein Z independently represents a $C_1$–$C_6$ alkyl, aryl, alkyl aryl and mixtures thereof.

c) Coupling of the Alpha-halosugar Derivative

Finally, the alpha-halo fatty acylamide derivative of the sugar is then reacted with dithiol to produce the alkyl sulfur bridged sugar gemini molecule.

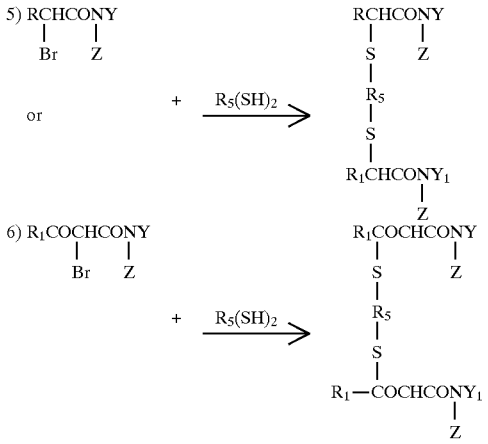

Whereas the surfactants of the invention can be used alone as the essential hydrotrope component, it has been unexpectedly found that blends of the compounds of the invention with certain conventional well known anionic, nonionic, cationic and amphoteric surfactants provide results beyond that expected and are therefore synergistic, a phenomenon that can be demonstrated in terms of critical micelle concentration and surface tension reducing ability.

Examples of the nonionic surfactants used herein include fatty acid glycerine esters, sorbitan fatty acid esters, sucrose fatty acid esters, polyglycerine fatty acid esters, higher alcohol ethylene oxide adducts, single long chain polyoxyethylene alkyl ethers, polyoxyethylene alkyl allyl ethers, polyoxyethylene lanolin alcohol, polyoxyethylene fatty acid esters, polyoxyethylene glycerine fatty acid esters, polyoxyethylene propylene glycol fatty acid esters, polyoxyethylene sorbitol fatty acid esters, polyoxyethylene castor oil or hardened castor oil derivatives, polyoxyethylene lanolin derivatives, polyoxyethylene fatty acid amides, polyoxyethylene alkyl amines, an alkylpyrrolidone, glucamides, alkylpolyglucosides, mono- and dialkanol amides, a polyoxyethylene alcohol mono- or diamides and alkylamine oxides. Examples of the anionic surfactants used herein include fatty acid soaps, ether carboxylic acids and salts thereof, alkane sulfonate salts, α-olefin sulfonate salts, sulfonate salts of higher fatty acid esters, higher alcohol sulfate ester salts, fatty alcohol ether sulfates salts, higher alcohol phosphate ester salts, fatty alcohol ether phosphate ester salts, condensates of higher fatty acids and amino acids, and collagen hydrolysate derivatives.

Examples of the cationic surfactants used herein include alkyltrimethylammonium salts, dialkyldimethylammonium salts, alkyldimethylbenzylammonium salts, alkylpyridinium salts, alkylisoquinolinium salts, benzethonium chloride, and acylamino acid type cationic surfactants.

Examples of the amphoteric surfactants used herein include amino acid, betaine, sultaine, phosphobetaines, imidazoline type amphoteric surfactants, soybean phospholipid, and yolk lecithin.

Any of the commonly used auxiliary additives such as inorganic salts such as Glauber salt and common salt, builders, humectants, solubilizing agents, UV absorbers, softeners, chelating agents, and viscosity modifiers may be added to the surfactants of the invention or blends thereof with other surfactants as disclosed herein.

The nonionic surfactants of the invention are extremely mild and non-irritating to both eyes and skin. They also exhibit enhanced wetting speed, greater surface tension reduction, high foaming and foam stabilization properties, low toxicity, and excellent compatibility with other anionic, cationic, and nonionic surfactants. They show unique performance attributes i.e., superior solubilization of co-ingredients, stabilization of enzymes and the enhanced removal of stains. The products of the invention are stable over a wide pH range and are biodegradable. These properties make these surfactants adaptable for use in products ranging from cosmetics to industrial applications and are usable wherever anionic surfactants have found use. These products are particularly useful for non-irritating shampoos, including baby shampoos, body shampoos including bubble baths, bar soaps, bath gels, hair conditioning gels, lotions, skin creams and lotions, make up removal creams and lotions, liquid detergents, dish detergents, and other washing and cosmetic products that contact the skin. The surfactants of the invention can also find use as hard surface cleaners including cars, dishes, toilets, floors, and the like; laundry detergents and soaps, metal working aids and the like. They are also compatible with bleaching agents and are able to stabilize enzymes and enhance the removal of oily soils in detergent systems.

The following examples are provided as a means to teach ways to synthesize the surfactants of the present invention as well as their improved properties. They are for illustrative purposes only, and it is recognized that there are many possible changes that may be made with respect to the process parameters, starting materials and their respective amounts. It is to be understood that to the extent any such changes do not materially alter the final composition or product, they are to be considered as falling within the spirit and scope of the invention, as later defined by the claims.

EXAMPLE 1

Preparation of 1,2-Ethylenedithiobis (N-lauroyl-N'-methylglucamine)

A.) Synthesis of alpha N-bromolauroyl-N'-methylglucamine

Alpha bromolauroyl chloride (40.2 g) was added to a 30% aqueous solution of N-methylglucamine (40 g), i.e. dropwise, at zero to five degrees. The pH of the solution was kept above 9.0 by adding a saturated aqueous sodium carbonate solution. The reaction was stirred overnight at room temperature. It was then heated to 46° C. and held for three hours. The final product was obtained by extracting the mixture two times with n-butanol. After evaporating the butanol, the remaining solid material was washed with ethanol several times. A white solid was collected by filtration. The NMR result showed that the solid material is consistent with the expected product.

B.) Preparation of 1,2-Ethylenedithio bis (N-lauroyl-N'-methylglucamine)

Methanol was added to 4.28 g of alpha N-bromolauroyl-N'-methylglucamine (prepared in part A) in order to solubilize the compound. Ethylenedithiol (0.49 g) and sodium carbonate (1.5 g) were then added to the solution. The reaction was refluxed overnight at 71° C. The reaction was quenched by cooling to room temperature and poured into water. Crude product was extracted twice with n-butanol. After evaporating the solvent, the remaining product was dissolved in ethanol. The inorganic salt was removed by filtration. An alcohol layer was collected and rotevaporated under reduced pressure. The final product was dried under vacuum. The NMR agreed with the expected structure of the final product.

EXAMPLE 2

Preparation of Lactosyl Derivative

A.) Lactosamine

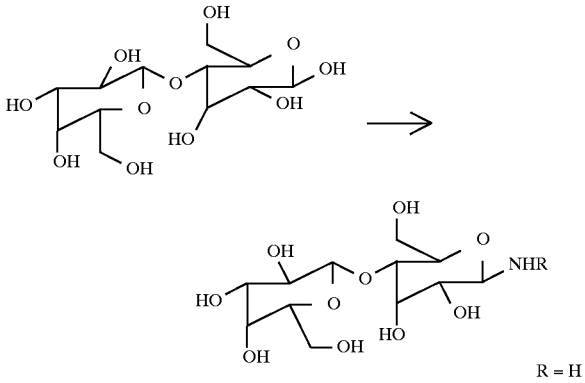

Lactosamine was prepared by the methods disclosed in the references cited in II b, supra.

B.) Synthesis of Alpha Bromolauroyl-lactosamine

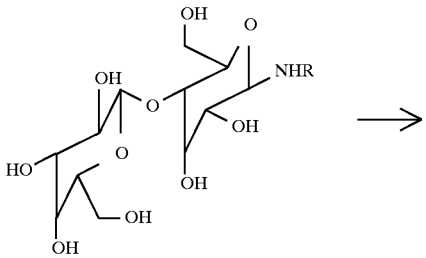

-continued

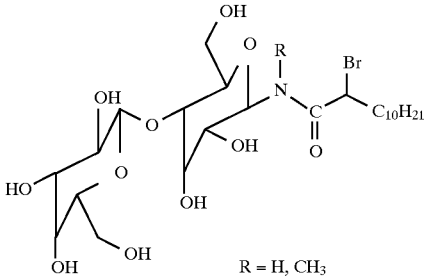

Alpha-bromolauroyl chloride (0.50 g) was added dropwise to a 30% aqueous solution of lactosamine (0.7 g) at zero degrees centigrade. The pH of the solution was kept above 9.0 by adding saturated sodium carbonate water solution. The reaction was stirred overnight at room temperature. It was then heated to 36° C. for an additional hour. The final product was obtained by extraction two times with n-butanol. After evaporating butanol, the remaining solid material was washed with cold ethanol. The final product was collected by filtration. The NMR spectra showed that the solid material is the expected product. The yield of the reaction was 75%.

C.) Preparation of Coupled Product

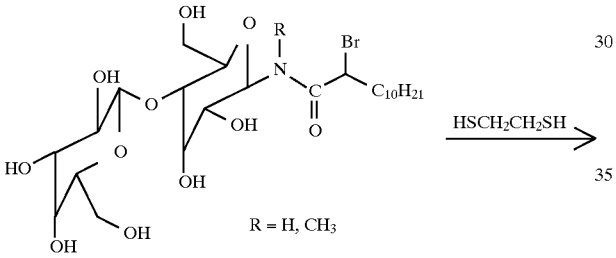

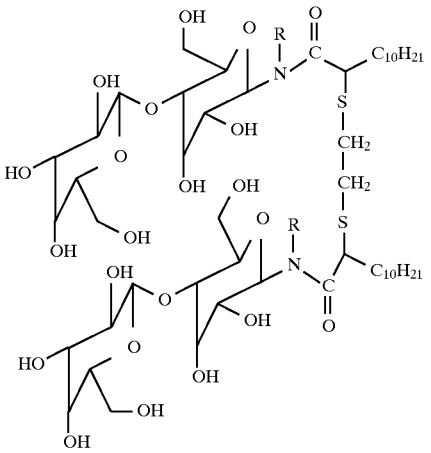

Alpha-bromolauric-lactosamine amide (1.0 g) was dissolved in pure methanol at room temperature. Then the ethylenedithiol (0.10 g) and sodium carbonate (1.0 g) were added to the above solution. The reaction was stirred by 55° C. overnight and then was stopped by cooling to room temperature. The reaction mixture was poured into water. The crude product was extracted two times with n-butanol. After evaporating the solvent, the remaining product was dissolved in ethanol. Inorganic salt was removed by filtration. The alcohol layer was collected and rotevaporated under reduced pressure. The final product was dried under vacuum. The NMR spectra agreed with the structure of the final product.

EXAMPLE 3

Preparation of Lactosyl Derivative (R=$CH_3$)

A.) Methylactosamine

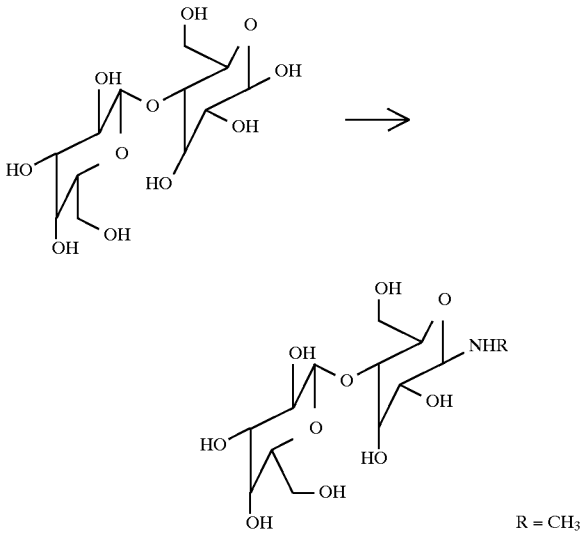

N-Methyl-lactosamine was prepared by the methods disclosed in the references cited in II b, supra.

B.) Synthesis of Alpha Bromo-N-Methyl-lauroyl lactosamine

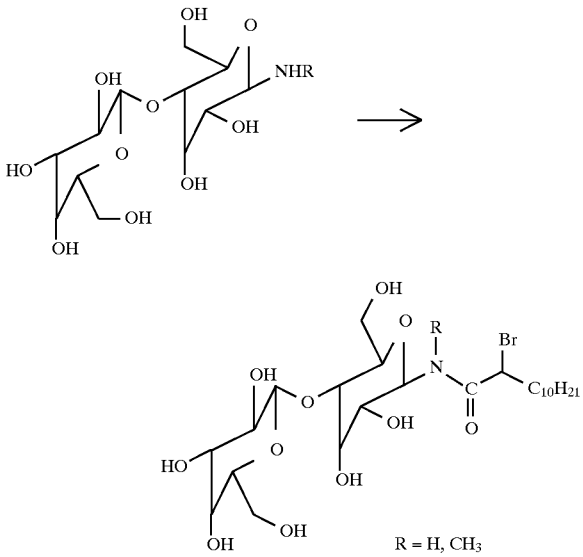

Alpha-bromolauroyl chloride (2.4 g) was added dropwise to a 30% aqueous solution of N-methyl-lactosamine (3.5 g) at zero degrees centigrade. The pH of the solution was maintained above 9 by the addition of a saturated aqueous sodium carbonate solution. The reaction was stirred overnight at room temperature. It was then heated up to 36° C. for an additional hour. The final product was obtained by extraction two times with n-butanol. The organic layer was dried with sodium sulfate and then rotevaporated under vacuum. The final product was taken for NMR analysis. The result confirmed that the solid material is the expected product. The yield of reaction was 80%.

C.) Preparation of Coupled Product

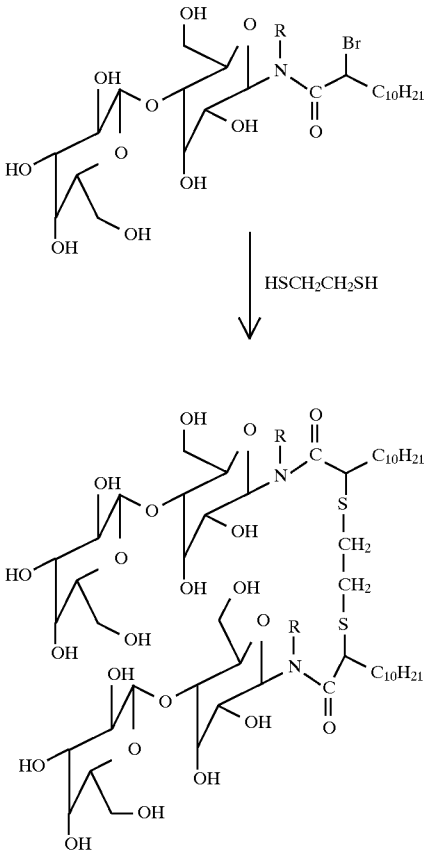

Alpha-bromolauroyl-N-methyllactosamine (3.0 g) was dissolved in pure methanol at room temperature. The ethylenedithiol (0.30 g) and sodium carbonate (2.5 g) were then added to the above solution. The reaction was stirred by 50° C. overnight and quenched by cooling to room temperature and drowning into water. The crude product was extracted with n-butanol twice. After evaporating the solvent, the remaining product was dissolved in ethanol. Inorganic salt was removed by filtration. The alcohol layer was collected and rotevaporated under reduced pressure. The final product was dried under vacuum. The NMR spectrum agreed with the structure of the final product.

EXAMPLE 4

Surface Properties

The effectiveness of the surfactant of Example 1 was tested by measuring its critical micelle concentration behavior in water. Example 1 is a nonionic surfactant and was compared to a single strand nonionic alkyl glucoside.

Critical Micelle Concentration (cmc)

Aqueous solutions of a surfactant were prepared at varying concentrations. The surface tension at 20° C. was measured by the Wilhelmy plate method and plotted vs. the logarithm of the concentration. The critical micelle concentration was determined as the value at which the slope of the line changed abruptly.

The surface activity of new sugar-derived gemini surfactant prepared in Example 1 (the surfactant whose structure is listed below) was compared to the surface active properties of a $C_{12.5}$H-glycoside. The results are given in Table I;

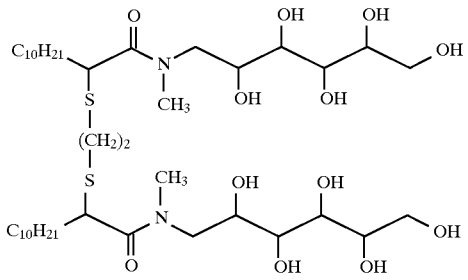

TABLE 1

| SURFACTANTS | cmc (w %) @ 25° C., WATER | SURFACE TENSION (DYNE/CM) |
|---|---|---|
| Example 1 | 0.001 | 28.9 |
| $C_{12.5}$H-glycoside* | 0.004 | 27.7 |

*2nd World Conference on Detergents, AOCS press, p 268, 1987

As one can see, the cmc of the nonionic sugar-derived gemini is four times lower than and hence possess more effective surface activity than that of the alkyl glycoside.

As can be seen from the respective derived values, the surfactants afford superior foaming characteristics and enhanced surface tension reduction properties. This unusually high surface activity for these molecules is a result of their unique structure; the presence of two optimally spaced hydrophobic chains and hydrophilic groups.

When the surface properties for the nonionic sugar gemini surfactant compounds of the invention were compared to the corresponding conventional nonionic surfactants, the novel compounds of the invention showed two unexpected surface active properties; unusually low critical micelle concentration (cmc) and $pC_{20}$ values in aqueous media. These properties are a measure of the tendency of the surfactant to form micelles and adsorb at the interface, and consequently, reduce surface tension.

This unusually high surface activity for these molecules is a result of their unique structure; the presence of two optimally spaced hydrophobic chains and hydrophilic groups.

This molecular structure provides energetically favorable decreases in the free energy of adsorption and micellization through the favorable distortion of water structure, and, at the same time, providing a "close packed" arrangement at the interface. This is reflected by the relatively low surface area per molecule that is unexpected from the molecular dimensions for the molecule. The area per molecule for the compounds of the invention are comparable to corresponding conventional surfactants. The ability of the compounds of the invention to distort water structure through inhibition of crystalline or liquid crystalline phase formation in bulk phase and at the same time to pack closely on adsorption at the interface is contrary to conventional wisdom. This again demonstrates the uniqueness of the molecular design for these compounds which is very critical to providing the unexpected exceptional surface and performance properties.

The exceptional surface activity and unique structural features of the surfactants of the present invention provide two other important performance properties that can have immense practical application in industry. One is their hydrotropicity which is the ability of organic substances to increase the solubility of other insoluble organic substances in water, and two, solubilization, the ability to dissolve water insoluble organic compounds into aqueous surfactant solutions above their cmc levels. The compounds of the invention, because of their very low cmc values, are efficient solubilizers. This latter property will not only allow the formulation of homogeneous water insoluble materials, but also will enhance the surface activity of other surfactants whose low water solubility restrict their use. These novel surfactants of the invention are far better than comparable conventional surfactants in hydrotroping and solubilizing properties.

Because of their unusually high surface activity, coupled with their hydrotropicity and solubilization properties, compounds of this invention will provide exceptionally high performance properties, at very low concentrations, in practical applications such as detergency emulsification, solubilization, dispersancy, hydrotropicity, foaming and wetting. In addition, due to their extremely low monomer concentration at standard use levels and because of their extremely low cmc values, the use of lower concentrations of the compounds of the invention than conventional surfactants can provide extremely low or no irritancy in personal care applications as well as being non-toxic, biodegradeable and environmentally friendly.

What we claim is:

1. A surfactant composition comprising compounds of the general formula:

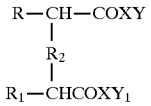

wherein $R(CO)_n$— and $R_1(CO)_n$— can be the same or different and comprise a $C_1$ to $C_{30}$ alkyl, aryl, or aryl, alkyl, where n is or I, and $R_2$ is a $C_1$ to $C_{10}$ alkylene, arylene and the hydroxy-substituted derivatives thereof, a polyether (—$O(R_4O)_x$—) wherein $R_4$ is a $C_2$ to $C_4$ alkylene and x is a whole number of from 1 to about 100; —S—, —$SO_2$—, —O—, —S—S—, —O—$R_5$—O— or —S—$R_5$—S and $R_5$ is a $C_1$ to $C_{10}$alkylene, arylene or alkylarylene, —N($R_6$)— or —($NR_6$) $R_7$ ($NR_6$)— wherein $R_6$ is a $C_2$ to $C_6$ alkyl and $R_7$ is a $C_2$ to $C_6$alkylene or arylene with the further stipulation that $R_6$ and $R_7$ may form a heterocyclic ring, X is O or NZ wherein Z is a $C_1$–$C_{10}$ alkyl, aryl, alkylaryl or hydrogen and Y and $Y_1$ represent alcohol-containing hydrocarbyl groups, each having two or more hydroxyl groups.

2. The surfactant composition of claim 1 wherein XY and $XY_1$ are selected from the group consisting of sugars, amino sugars, alkyl amino sugars, hydrogen and mixtures thereof.

3. The surfactant composition of claim 2 wherein said sugar is selected from the group consisting of monosaccharides, dissaccharides, polysaccharides and mixtures thereof.

4. The surfactant composition of claim 3 wherein said monosaccharides are selected from the group consisting of glyceraldehyde, erythrose, threose, ribose, arabinose, xylose, fructose, lyxose, allose, altrose, glucose, mannose, gulose, idose, galactose, talose and mixtures thereof.

5. The surfactant composition of claim 3, wherein said dissacharide is selected from the group consisting of lactose, maltose, sucrose, cellobiose, gentibiose and mixtures thereof.

6. The surfactant composition of claim 3, wherein said polysaccharide is selected from the group consisting of amylose, amylopectin, trehalose and mixtures thereof.

7. The surfactant compositions of claim 1 comprising compounds of the formula:

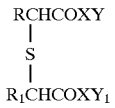

wherein R, $R_1$, X, Y and $Y_1$ have been hereinbefore defined.

8. The surfactant compositions of claim 1 comprising compounds of the formula:

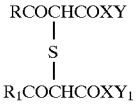

wherein R, $R_1$, X, Y and $Y_1$ have been hereinbefore defined.

9. The surfactant compositions of claim 1 comprising compounds of the formula:

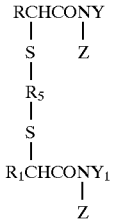

wherein R, $R_1$, X, Y and $Y_1$ have been hereinbefore defined, $R_5$ is a $C_1$ to $C_{10}$ alkylene, arylene or alkylarylene, —N($R_6$)— and —N($R_6$)—$R_7$—($R_6$)N— wherein $R_6$ is a $C_2$ to about $C_6$ alkyl and $R_7$ is a $C_2$ to $C_6$alkylene or arylene with the further stipulation that $R_6$ and $R_7$ may form a heterocyclic ring and Z independently represents a $C_1$–$C_{10}$ alkyl, aryl, alkylaryl and mixtures thereof.

10. The surfactant compositions of claim 1 comprising compounds of the formula:

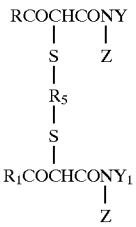

wherein R, $R_1$ Y and $Y_1$ have been hereinbefore defined, $R_5$ is a $C_1$ to $C_{10}$ alkylene, arylene or alkylarylene, —N($R_6$)— and —N($R_6$)—$R_7$—($R_6$)N— wherein $R_6$ is a $C_2$ to about $C_6$ alkyl and $R_7$is a $C_2$ to $C_6$ alkylene or arylene with the further stipulation that $R_6$ and $R_7$ may form a heterocyclic ring and Z independently represents a $C_1$–$C_{10}$ alkyl, aryl, alkylaryl and mixtures thereof.

11. A surfactant composition of claim 2, further comprising an additional surfactant selected from the group consisting of an anionic, nonionic, cationic, and amphoteric surfactant.

12. The surfactant composition of claim 11, wherein said nonionic surfactant is selected from the group consisting of a fatty acid glycerine ester, a sorbitan fatty acid ester, a sucrose fatty acid ester, a polyglycerine fatty acid ester, a higher alcohol ethylene oxide adduct, a single long chain polyoxyethylene alkyl ether, a polyoxyethylene alkyl allyl ether, a polyoxethylene lanolin alcohol, a polyoxyethylene fatty acid ester, a polyoxyethylene glycerine fatty acid, a polyoxyethylene propylene glycol fatty acid ester, a polyoxyethylene sorbitol fatty acid ester, a polyoxyethylene castor oil or hardened castor oil derivative, a polyoxyethylene lanolin derivative, a polyoxethylene fatty acid amide, a polyoxyethylene alkyl amine, an alkyl pyrrolidone, glucamides, alkylpolyglucosides, a mono- or dialkanol amide, a polyoxyethylene alcohol, mono- or diamide, an alkylamine oxide, and mixtures thereof.

13. The blend of surfactants of claim 11, wherein said anionic surfactant is selected from the group consisting of a fatty acid soap, an ether carboxylic acid or it's salt thereof, an alkane sulfonate salt, an a-olefin sulfonate salt, a sulfonate salt of a higher fatty acid ester, a higher alcohol sulfate ester salt, fatty alcohol ether sulfate salts, a higher alcohol phosphate ester salt, a fatty alcohol ether phosphate ester salt, a condensate of higher fatty acids and amino acids, and a collagen hydrolysate derivative.

14. The blend of surfactants of claim 11, wherein said cationic surfactant is selected from the group consisting of an alkyltrimethylammonium salt, a dialkyldimethylammonium salt, an alkyldimethylbenzylammonium salt, an alkylpyridinium salt, an alkylisoquinolinium salt, benzethonium chloride, and an acylamino acid type cationic surfactant.

15. The blend of surfactants of claim 11, wherein said amphoteric surfactant is selected from the group consisting of amino acids, betaines, sultaines, phosphobetaines, imidazoline-type amphoteric surfactants, soybean phospholipid, and yolk lecithin.

16. A cleaning composition comprising an aqueous solution having a cleaningly effective amount of the composition of claim 1 dissolved therein.

17. The cleaning composition of claim 16, wherein the solution is selected from the group consisting of hair shampoos, baby shampoos, body shampoos, bubble baths, bar soaps, bath gels, hair conditioning gels, skin creams and lotions, skin contacting cosmetics, make up removal creams and lotions, liquid detergents, dish detergents, liquid soaps, bleach activators, and bleach stablizers.

* * * * *

UNITED STATES PATENT AND TRADEMARK OFFICE

CERTIFICATE OF CORRECTION

PATENT NO. : 5,863,886 
DATED : January 26, 1999
INVENTOR(S) : David James Tracy, Ruoxin Li and Jiang Yang It is certified that error appears in the above-identified patent and that said Letters Patent is hereby corrected as shown below:

Title page,
Item [57], ABSTRACT,
Line 3, delete the structure " R-CH-COXY " and insert - - R(CO)$_n$-CH-COXY - -

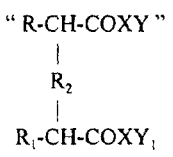

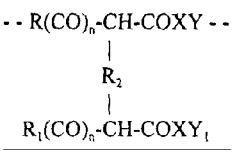

Line 4, delete "R(CO)$_n$ - and R$_1$(CO)$_n$" and insert -- R and R$_1$ --.
Line 5, after "C$_{30}$ alkyl", insert -- aryl, --.
Line 5, after "or" delete "alkyl aryl" and insert -- alkylaryl, n is 0 or 1 --.

Column 4,
Line 10, delete the structure " R-CH-COXY " and insert - - R(CO)$_n$-CH-COXY - -

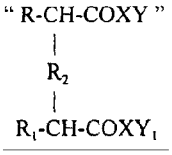

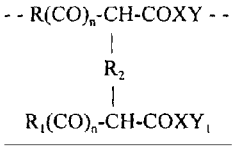

Line 11, delete "R(CO)$_n$ - and R$_1$(CO)$_n$" and insert -- R and R$_1$ --.
Line 12, after "unsaturated alkyl", insert -- , --.
Line 14, after "n is" delete "O or I" and insert -- 0 (zero) or 1 --.

Signed and Sealed this

Sixteenth Day of March, 2004

JON W. DUDAS
*Acting Director of the United States Patent and Trademark Office*